US009297123B1

(12) United States Patent
Benjamin

(10) Patent No.: US 9,297,123 B1
(45) Date of Patent: Mar. 29, 2016

(54) WATER-FILLED STAIRS

(71) Applicant: Gordon Benjamin, Wallace (CA)

(72) Inventor: Gordon Benjamin, Wallace (CA)

( * ) Notice: Subject to any disclaimer, the term of this patent is extended or adjusted under 35 U.S.C. 154(b) by 227 days.

(21) Appl. No.: 14/165,641

(22) Filed: Jan. 28, 2014

(51) Int. Cl.

| | |
|---|---|
| ***E04H 4/00*** | (2006.01) |
| ***E01C 9/08*** | (2006.01) |
| ***E01C 11/16*** | (2006.01) |
| ***E01C 11/24*** | (2006.01) |
| ***E04F 11/02*** | (2006.01) |

(52) U.S. Cl.
CPC . *E01C 9/08* (2013.01); *E01C 11/16* (2013.01); *E01C 11/24* (2013.01); *E04F 11/02* (2013.01)

(58) Field of Classification Search
CPC ..... E04H 4/14
USPC ..... 4/488–513
See application file for complete search history.

(56) References Cited

U.S. PATENT DOCUMENTS 1,475,777 A * 11/1923 Ballenger ..... E04F 11/025 52/189
D290,044 S * 5/1987 Daly ..... E04F 11/025 D25/62
4,706,425 A * 11/1987 Brumbalough ..... E04F 11/1043 52/182
5,794,391 A * 8/1998 Howard ..... E01C 11/265 52/182
5,967,519 A * 10/1999 Cumberland ..... A63B 67/002 273/317.6
6,585,610 B2 * 7/2003 Sompolinsky ..... A63B 67/002 273/348
6,763,532 B2 * 7/2004 Gardenier ..... A47K 3/001 4/496
7,150,129 B2 * 12/2006 Elder ..... E04H 4/144 4/488
D623,804 S * 9/2010 Deeley ..... A01K 1/035 D30/120
7,909,330 B2 * 3/2011 Domjen ..... A63B 69/002 273/396
8,037,649 B2 * 10/2011 Jakubowski ..... A01K 1/035 403/361
8,936,134 B2 * 1/2015 Lipniarski ..... E04H 4/144 182/151
2006/0272230 A1 * 12/2006 Elwood ..... E04F 11/035 52/182
2007/0289556 A1 * 12/2007 Hoffman ..... A01K 1/035 119/847

FOREIGN PATENT DOCUMENTS

| | | | |
|---|---|---|---|
| CN | 202370193 | 8/2012 | |
| DE | EP 1672136 A2 * | 6/2006 | ..... E04F 11/035 |
| EP | 1672136 | 12/2004 | |

* cited by examiner

*Primary Examiner* — Lori Baker

(57) ABSTRACT

The water-filled stairs involves a modular staircase that is to be used on a temporary basis, and which is of hollowed construction so as to be filled with water when in use for the purpose of weighing down the staircase. The water-filled stairs is further defined with a plurality of steps adorning a top surface, and a flattened bottom surface. Distal ends of the water-filled stairs include a hook or connecting bar such that consecutive staircases may be attached to accommodate the needs of a particular application. Each staircase includes a male threaded port adjacent a top distal end as well as a bottom distal end. A flexible hose attaches in between the male threaded ports of adjacent staircases in order for a single water source to fill all staircases simultaneously.

4 Claims, 5 Drawing Sheets

WATER-FILLED STAIRS

CROSS REFERENCES TO RELATED APPLICATIONS

Not Applicable

STATEMENT REGARDING FEDERALLY SPONSORED RESEARCH

Not Applicable

REFERENCE TO APPENDIX

Not Applicable

BACKGROUND OF THE INVENTION

A. Field of the Invention

The present invention relates to the field of staircases, more specifically, a temporary staircase that is water-filled.

SUMMARY OF THE INVENTION

An embodiment of the disclosure meets the needs presented above by generally comprising a modular staircase that is to be used on a temporary basis, and which is of hollowed construction so as to be filled with water when in use for the purpose of weighing down the staircase. The water-filled stairs is further defined with a plurality of steps adorning a top surface, and a flattened bottom surface. Distal ends of the water-filled stairs include a hook or connecting bar such that consecutive staircases may be attached to accommodate the needs of a particular application. Each staircase includes a male threaded port adjacent a top distal end as well as a bottom distal end. A flexible hose attaches in between the male threaded ports of adjacent staircases in order for a single water source to fill all staircases simultaneously.

An object of the invention is to provide a temporary staircase design that is modular, and which can be easily installed to provide a safe staircase for outdoor use.

Another object of the invention is for the water-filled stairs to be filled with water in order to weigh down the staircase(s) for use.

Another object of the invention is for the staircases to be modularized such that a plurality of staircases may be attached linearly to accommodate the particular use.

Another object of the invention is for the staircases to include male-threaded ports in order to fill or drain the respective staircase with water.

These together with additional objects, features and advantages of the water-filled stairs will be readily apparent to those of ordinary skill in the art upon reading the following detailed description of presently preferred, but nonetheless illustrative, embodiments of the water-filled stairs when taken in conjunction with the accompanying drawings.

In this respect, before explaining the current embodiments of the water-filled stairs in detail, it is to be understood that the water-filled stairs is not limited in its applications to the details of construction and arrangements of the components set forth in the following description or illustration. Those skilled in the art will appreciate that the concept of this disclosure may be readily utilized as a basis for the design of other structures, methods, and systems for carrying out the several purposes of the water-filled stairs.

It is therefore important that the claims be regarded as including such equivalent construction insofar as they do not depart from the spirit and scope of the water-filled stairs. It is also to be understood that the phraseology and terminology employed herein are for purposes of description and should not be regarded as limiting.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE EMBODIMENT

Figure 1:
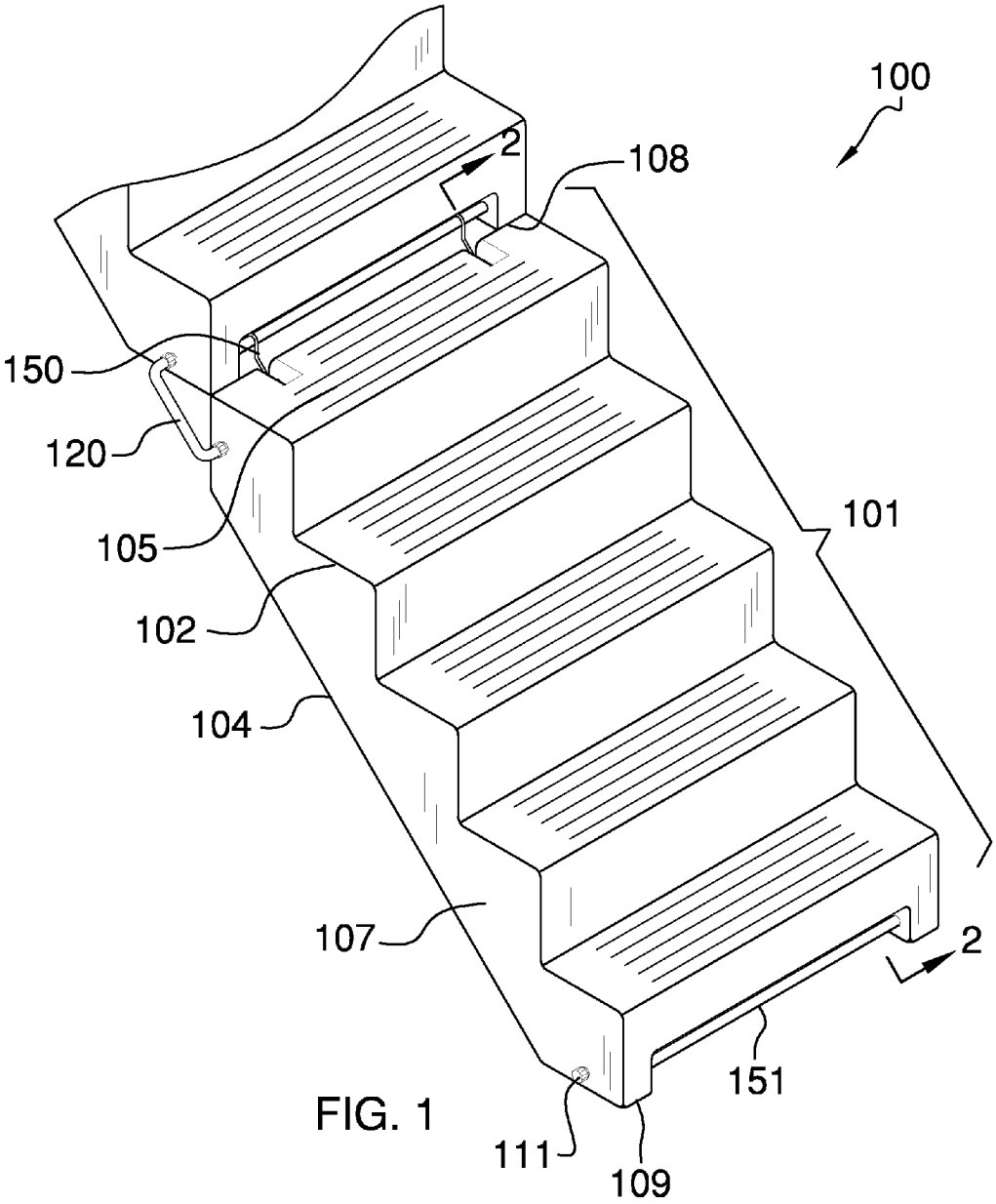
FIG. 1 is a perspective view of the water-filled stairs.
Figure 2:
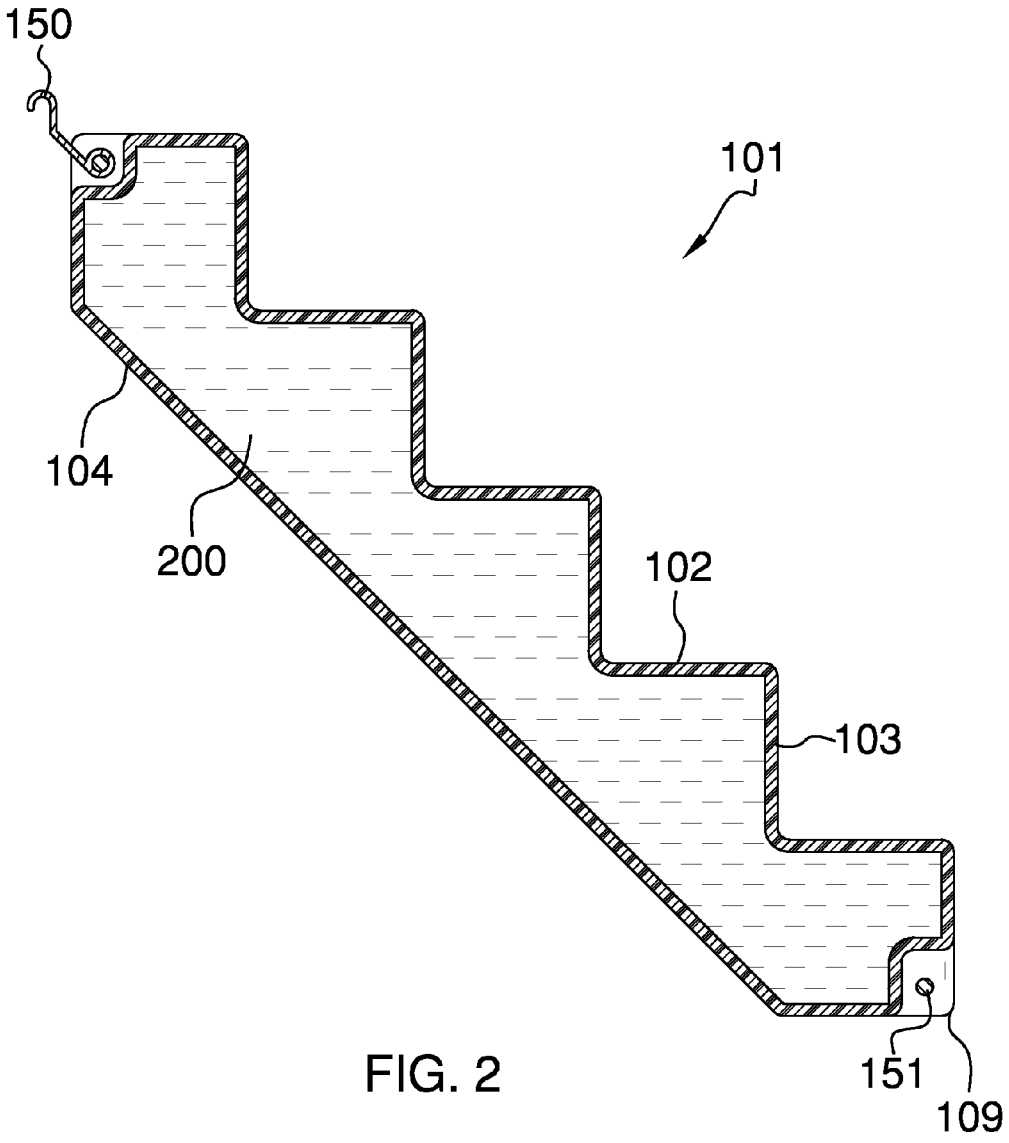
FIG. 2 is a cross-sectional view of the water-filled stairs along line 2-2 in FIG. 1.
Figure 3:
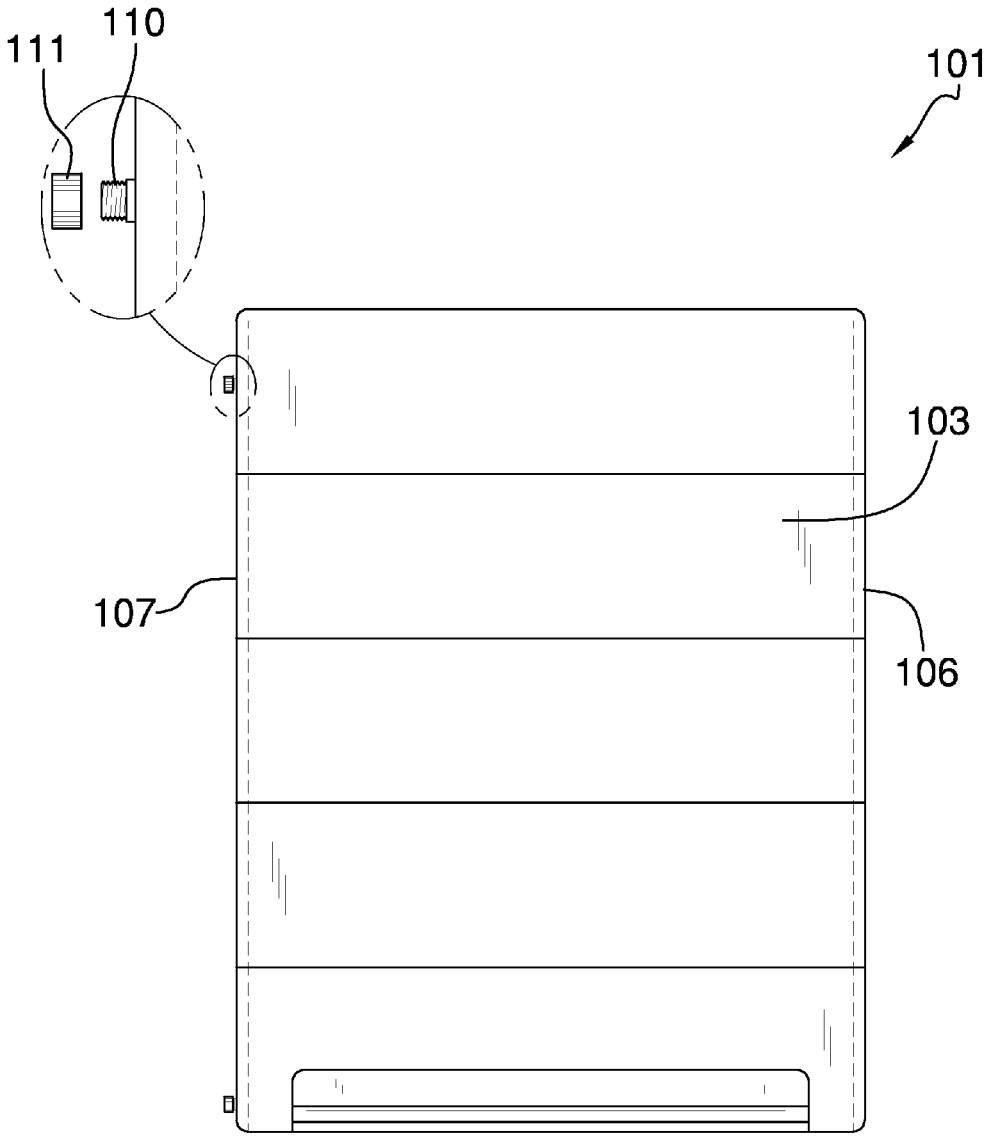
FIG. 3 is a front view of the water-filled stairs.
Figure 4:
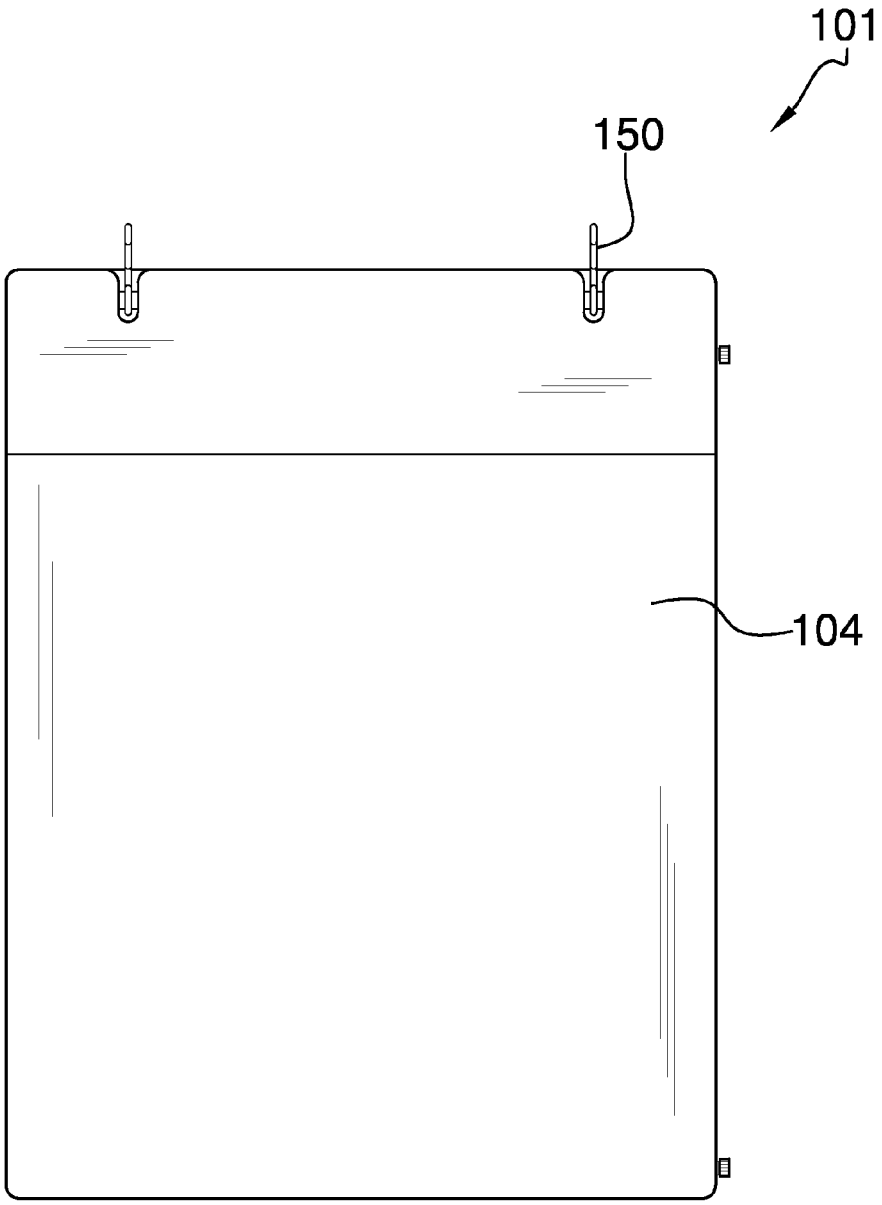
FIG. 4 is a rear view of the water-filled stairs.

The following detailed description is merely exemplary in nature and is not intended to limit the described embodiments of the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description.

As best illustrated in FIGS. 1 through 5, the water-filled stairs 100 (hereinafter invention) generally comprises a staircase housing 101 that is further defined with a plurality of steps 102 adorning a top surface 103. The staircase housing 101 is further defined with a flat bottom surface 104, which is opposite the top surface 103. The steps 102 may include tread 105 thereon to aid in providing traction when being stepped upon.

The staircase housing 101 is of hollowed construction, and is further defined with a left side surface 106 as well as a right side surface 107. The left side surface 106 or the right side surface 107 is provided with a pair of male threaded port members 110. The male threaded port members 110 being provided adjacent to a top distal edge 108 and a bottom distal edge 109. The male threaded port members 110 are important in that the staircase housing 101 may be fully or partially filled with water 200. The invention 100 is configured to be filled with water 200 in order to weigh down the invention 100 during use.

The male threaded port members 110 may include a screw on cap 111 to seal off the male threaded port members 110 between filling or draining of the water 200. Moreover, the invention 100 may utilize a flexible conduit 120 to connect to two consecutive staircase housings 101. That being said, the invention 100 is modular in that a plurality of staircase housings 101 may be connected linearly in order to defined a use length 130 as needed.

The flexible conduit 120 enables the two consecutive staircase housings 101 to be filled or drained of the water 200 simultaneously. Moreover, the bottommost of the male threaded port members 110 shall be opened in order to drain water 200 from all connected staircase housings 101. Moreover, the topmost of the male threaded port members 110 shall be opened in order to fill the staircase housings 101 with water 200.

The top distal edge 108 of the staircase housings 101 includes a hook member 150 whereas the bottom distal edge 109 includes a connecting bar member 151. The hook member 150 enables the staircase housing 101 to be hooked onto the connecting bar member 151 of an adjacent staircase housing 101.

Figure 5:
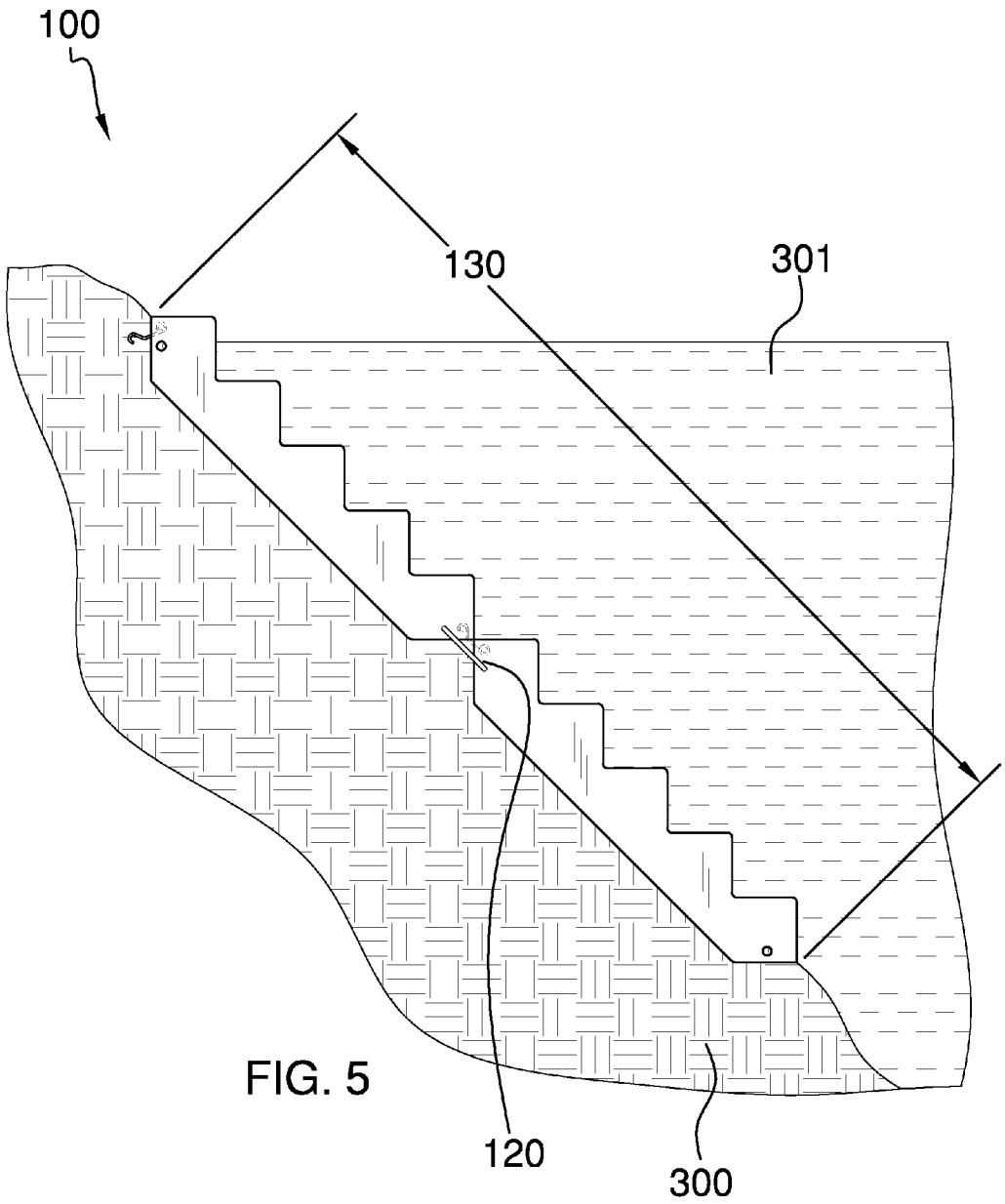
FIG. 5 is a side view of the water-filled stairs in use along a water bank.

Referring to FIG. 5, the invention 100 is configured to lie atop of a surface 300 in order to provide a plurality of steps for walking into or out of a body of water 301. It shall be noted that the invention 100 is intended to be used on a temporary basis, and shall be removed upon emptying all of the water 200 from within all staircase housings 101.

With respect to the above description, it is to be realized that the optimum dimensional relationship for the various components of the invention 100, to include variations in size, materials, shape, form, function, and the manner of operation, assembly and use, are deemed readily apparent and obvious to one skilled in the art, and all equivalent relationships to those illustrated in the drawings and described in the specification are intended to be encompassed by the invention 100.

It shall be noted that those skilled in the art will readily recognize numerous adaptations and modifications which can be made to the various embodiments of the present invention which will result in an improved invention, yet all of which will fall within the spirit and scope of the present invention as defined in the following claims. Accordingly, the invention is to be limited only by the scope of the following claims and their equivalents.

What is claimed is:

1. A set of water-filled stairs comprising:

a plurality of staircase housings that each includes a plurality of steps;

said staircase housing is hollow, and configured to be filled with water in order to add weight;

wherein the staircase housings are consecutively joined to form a use length;

wherein the staircase housing is configured to be placed on a surface of a body of water to provide a temporary set of stairs;

wherein the staircase housing is further defined with the plurality of steps adorning a top surface; wherein the staircase housing is further defined with a flat bottom surface, which is opposite the top surface;

wherein the steps include tread thereon to aid in providing traction when being stepped upon;

wherein the staircase housing is further defined with a left side surface as well as a right side surface;

wherein the left side surface or the right side surface is provided with a pair of male threaded port members;

wherein the male threaded port members being provided adjacent to a top distal edge and a bottom distal edge;

wherein the top distal edge of the staircase housings includes a hook member whereas the bottom distal edge includes a connecting bar member; wherein the hook member enables the staircase housing to be hooked onto the connecting bar member of an adjacent staircase housing.

2. The water-filled stairs according to claim 1 wherein the male threaded port members include a screw on cap to seal off the male threaded port members between filling or draining of the water.

3. The water-filled stairs according to claim 2 wherein a flexible conduit connects male threaded port members of two consecutive staircase housings; wherein the flexible conduit enables the two consecutive staircase housings to be filled or drained of the water simultaneously.

4. The water-filled stairs according to claim 3 wherein a bottommost of the male threaded port members is opened in order to drain water from all connected staircase housings; wherein a topmost of the male threaded port members is opened in order to fill the staircase housings with water.

* * * * *